United States Patent [19]

Krogh

[11] Patent Number: 4,508,344

[45] Date of Patent: Apr. 2, 1985

[54] SPINNER DEVICE

[76] Inventor: Kris K. Krogh, 6518 Madrid Rd. #7, Santa Barbara, Calif. 93117

[21] Appl. No.: 494,063

[22] Filed: May 12, 1983

[51] Int. Cl.[3] ..... A63B 71/06

[52] U.S. Cl. ..... 273/141 R; 434/198; 434/404

[58] Field of Search ..... 273/141 R, 141 A, 309; 108/103, 139; 434/404, 198

[56] References Cited

U.S. PATENT DOCUMENTS

| | | | |
|---|---|---|---|
| Re. 28,108 | 8/1974 | Lippert | 273/141 R |
| 848,839 | 4/1907 | Monroe | 273/141 R |
| 2,222,985 | 11/1940 | Markell | 273/309 |
| 2,717,158 | 9/1955 | Dieterich | 273/141 A |
| 2,902,775 | 9/1959 | Arrowsmith et al. | 273/141 R X |
| 3,224,112 | 12/1965 | Hanson | 273/141 R |

*Primary Examiner*—Richard C. Pinkham
*Assistant Examiner*—Scott L. Brown

[57] ABSTRACT

A spinner having easily changeable indicia and an upper section which can be turned for viewing the indicia from different directions. The indicia are printed on two-sided, symmetrically shaped cards, each having a large hole in the center and evenly spaced notches along its outer edge. A card is mounted by placing it on top of the device. The central hole accommodates the spinner's pointer, allowing disks to be changed without removing the pointer. When a disk is mounted, some of its notches mate with raised tabs on the upper section, holding it in place. The remaining notches permit access to finger notches in the upper section which facilitate turning it, in a fashion similar to telephone dialing. When the upper section is turned, the spinner's pointer turns together with the indicia.

12 Claims, 6 Drawing Figures

SPINNER DEVICE

CROSS-REFERENCES TO RELATED APPLICATIONS

A related application, directed to an educational game system, Ser. No. 06/420,487, group art unit 334, was filed Sept. 20th 1982. The present invention is partially disclosed therein. While the inventions in both applications are capable of independent usage, each includes embodiments which combine features of the other.

BACKGROUND OF THE INVENTION

1. Field of the Invention

The present invention relates to spinner devices such as those used for playing board games. In particular, it relates to spinner devices having changeable indicia.

2. Description of the Prior Art

The prior art discloses various types of spinner devices having changeable indicia.

U.S. Pat. No. 3,136,549 to Ruderian discloses a device whose indicia consist of pages in a book and whose pointer mechanism is slipped onto the pages like a large paper clip. Page 42 of the 1981 Creative Publications catalog of educational materials shows a pointer mounted on a transparent plastic covering device into which various cards can be slid.

U.S. Pat. Nos. 2,933,827 to Alberts and 4,243,223 to Ver Hoef et al. disclose spinners consisting of pointer mechanisms joined to suction cups which can be affixed, via suction, to various flat surfaces bearing indicia. U.S. Pat. No. 3,399,893 to Payne discloses a pointer mechanism joined to a magnet, together with a metallic base and various indicia-bearing cards, the magnet fitting through holes in the cards and adhering to the metallic base. The magnet-pointer assembly must be removed and then replaced when cards are changed.

U.S. Pat. No. 1,167,407 to Johnson discloses a spinner device consisting of a pointer mechanism joined to a cylindrical post, cards with central holes, and a wooden base also having a central hole. The cylindrical post fits through the holes in the cards and seats in the hole in the wooden base. The post-pointer assembly must be removed and then replaced when cards are changed.

U.S. Pat. No. 3,967,825 to Anania discloses a spinner device which includes both fixed and changeable indicia. The fixed indicia surround the pointer mechanism within a circular inner area, while the changeable indicia are printed on a ring which surrounds the fixed indicia. The drawings for this patent show a notch in the outer edge of each ring, which apparently mates with a raised tab on the surface of the device to assure proper alignment between the inner indicia and that on the rings. In distinction to the other prior art, with this device part of the indicia can be put in place simply by placing it on top. However, before a ring can be placed it must be turned such that the notch in the outer edge is in the proper position for mating. The amount of turning required can be as much as 180 degrees.

SUMMARY OF THE INVENTION

An object of the present invention is to provide a spinner device having changeable indicia and the following characteristics: 1. The indicia can be changed quickly and easily, even by children. 2. Except for the indicia, the spinner device has no removable parts which could be lost in usage. 3. Means are provided for reorienting the indicia for proper viewing from different directions. 4. The spinner's pointer can continue pointing to the same item in the indicia after reorientation. 5. The device is economical to manufacture.

To provide for viewing the indicia from different directions, the present invention is constructed with a turntable upper section. In this respect, the present invention is similar to a lazy Susan. Means are provided for affixing indicia to the upper section, and the device's pointer rests directly on the upper section when it has stopped spinning. This enables the indicia and pointer to be turned together for viewing from any direction.

The indicia consist of printed, interchangeable, two-sided cards. In the preferred embodiment, these cards have an overall disk shape. Each card has a large central hole which accomodates the pointer, making it possible to add or remove a card from the device without removing the pointer. In addition to simplifying card changing, this also means that the pointer can be permanently attached to the device where it will not be lost.

The indicia-bearing cards are affixed to the upper section of the device by means of raised tabs on the the upper section which mate with multiple notches cut in the outer edges of the disks. In the preferred embodiment, there are three raised tabs and twelve notches per card. The twelve notches permit a disk to be mounted in any of twelve different orientations. When placed over the upper section, a card must be turned, at most, 15 degrees to obtain mating. This can be achieved with only a slight turn of the wrist. The result is that cards can easily be put in place without paying close attention to tabs and notches.

While some of a card's notches mate with tabs when it is mounted on the device, the remaining notches permit access to finger notches in the upper section. These notches facilitate turning the upper section in a fashion similar to telephone dialing. The base is equipped with high friction foot pads to help keep the device in place when the upper section is turned.

Various methods of construction are disclosed which permit the device to be manufactured economically.

DESCRIPTION OF THE PREFERRED EMBODIMENTS

Figure 3:
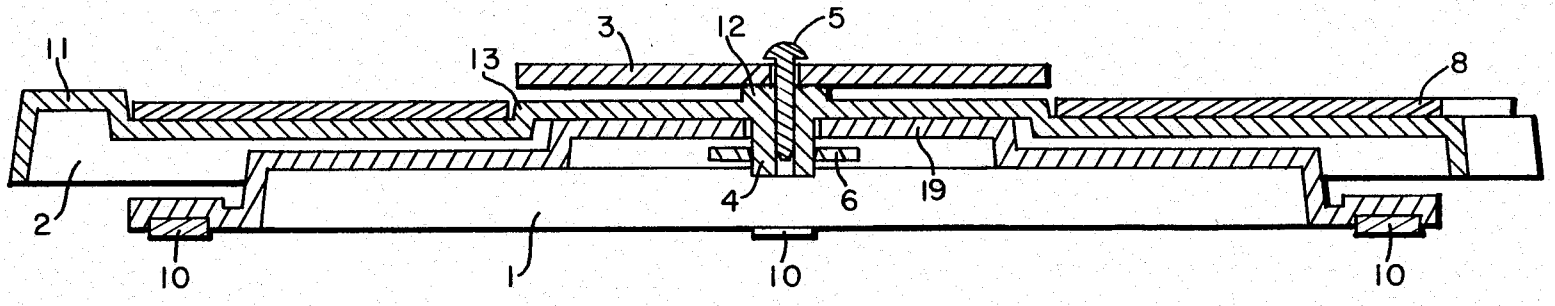
FIG. 3 is an enlarged vertical cross-sectional view taken along lines 9—9 of FIG. 1.
Figure 6:
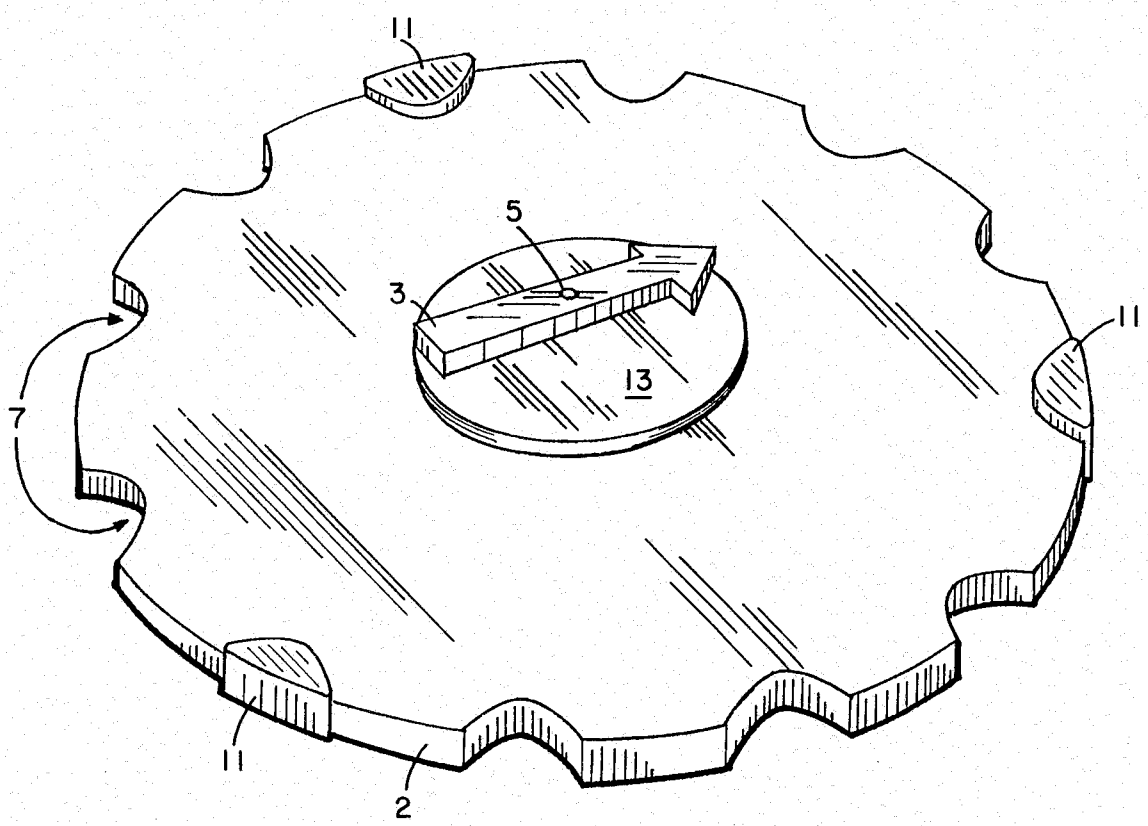
FIG. 6 is a perspective view of the present invention, without a problem disk mounted.

Three main parts of the present invention are shown in the cross-sectional view of FIG. 3; a base 1, upper section 2, and rotatable pointer 3. These parts are constructed preferably of molded plastic. (Other materials could also be used.) In addition, there is a set of indicia-bearing disks, one of which 8 is shown mounted on the device in FIG. 1. The disks are constructed of card-board or some other flat material. FIG. 6 shows the device without a problem disk mounted.

Figure 1:
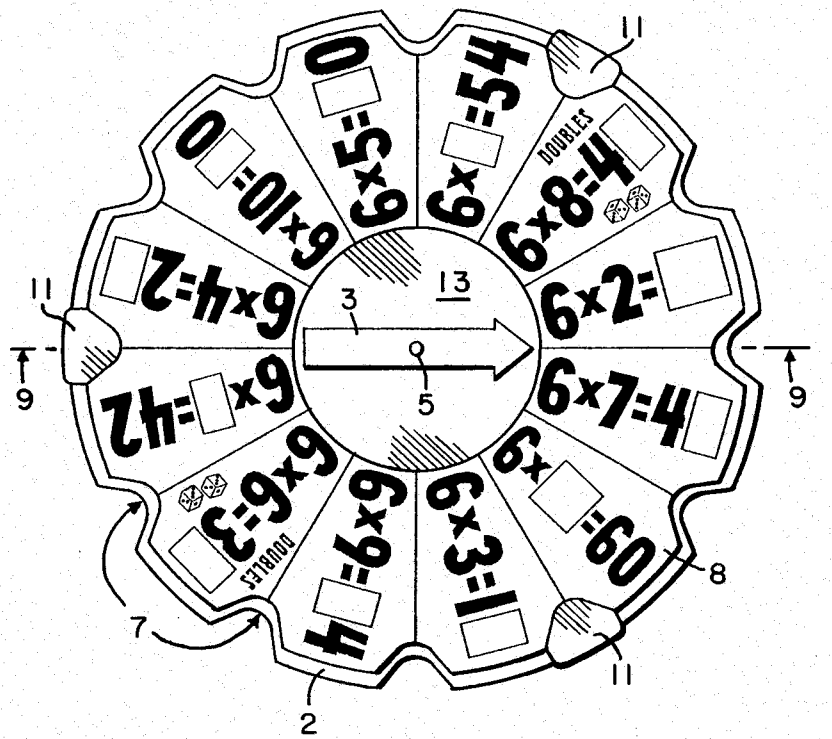
FIG. 1 is a top view of the present invention, with a problem disk mounted.

The rotatable pointer 3, shown in FIGS. 1 and 3, is secured by a metal (or plastic) pin 5. As shown in FIG. 3, the pointer 3 rests on a pedestal 12 in the center of the upper section 2. The pedestal diameter controls the amount of friction between the pointer and pedestal. The friction is low enough that the pointer can easily be spun through multiple revolutions with the single flick of a finger. There is also sufficient friction that, when the pointer has stopped, the upper section can be pivoted (as described below) and the pointer will move together with it. In the preferred embodiment, the diameter of the pedestal is roughly one sixth the length of the pointer.

As shown in FIG. 1, the present invention is constructed such that one of the indicia-bearing disks 8 can be placed on or removed from the upper section without removing the pointer 3. This is accomplished by providing a hole in the center of each disk 8 large enough to accomodate the pointer 3. The upper section has a raised area 13 which fits inside the disk holes and helps in centering disks on the device. In addition, three raised tabs 11 on the upper section mate with notches cut in the edges of the disks. This holds disks in a fixed position with respect to the upper section. The perspective view of FIG. 6 shows the raised central area 13 and raised tabs 11 clearly.

As shown in FIG. 3 the upper section also has a central member 4 which protrudes through a hole in the base 1. This member serves two functions. First, it serves as a seat for the pin 5 which secures the pointer. The pin seats in a hole whose diameter is normally smaller than that of the pin, holding it firmly. Secondly, the central member 4 serves as a pivot, permitting the upper section to be turned with respect to the base 1, like a lazy Susan. To prevent the upper section 2 and base 1 from separating when the device is picked up, a ring shaped push-on metal fastener 6 (or some other fastening device) is attached to the lower end of the central member 4.

Figure 4:
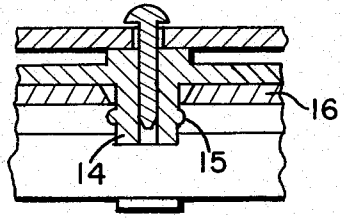
FIG. 4 is an enlarged vertical cross-sectional view corresponding to the central region of FIG. 3, showing an alternate method of construction.

FIG. 4 shows an alternate method for constructing the central member 4, where the push on fastener 6 of FIG. 3 is not needed. In this embodiment, the central member 14 is molded with a resiliently deformable beaded collar 15. The base 16 is joined to the upper section by pressing it over the collar, snapping it into place. The central hole in the base 16 is molded with a bevelled edge whose shape facilitates pressing it over the beaded collar and also helps prevent the base from being pried off once in place.

Figure 5:
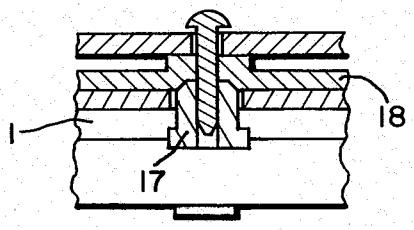
FIG. 5 is also an enlarged vertical cross-sectional view corresponding to the central region of FIG. 3, showing another method of construction.

FIG. 5 shows still another method for constructing the central member 17. In this embodiment, the central member consists of a separate part which is joined to the upper section 18 by cementing or welding. The construction sequence consists of first bringing the base 1 and upper section 18 together and then joining the central member 17 to the upper section 18. The hole for the pin 5 can be omitted initially and formed after the joining by drilling. The advantage of this embodiment over that shown in FIG. 4 is that a simpler, less expensive mold could be used to form the upper section.

Referring again to FIG. 3, the upper section 2 rests on a raised area 19 of the base 1. The diameter of this raised area 19 determines the amount of friction between the base and upper section when the upper section is turned (as described below). Some friction is needed to keep the upper section steady when the pointer 5 is being spun, yet the upper section 2 should turn easily when turning is desired. In the preferred embodiment, the raised area is roughly one fourth the diameter of the upper section. At this size, the raised area 19 is also small enough to fit inside the raised area of the upper section 13.

To facilitate turning the upper section 2, nine finger notches 7, shown in FIG. 6, are provided in its outer edge. Three notches are evenly spaced between each pair of raised tabs 11. As shown in FIG. 3, to help prevent the device from skidding when the upper section is being turned, three or four foot pads 10, made of a high friction material such as rubber, are attached to the bottom of the base 1.

Figure 2:
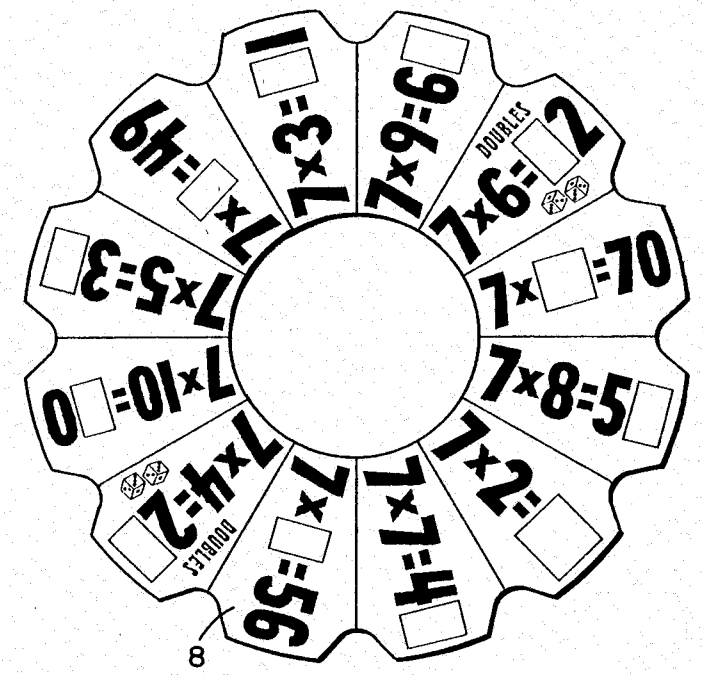
FIG. 2 shows the reverse side of the problem disk which appears in FIG. 1.

The present invention includes a set of various interchangeable indicia-bearing disks, each the same size and shape. These disks are mounted one at a time on the upper section 2, as shown in FIG. 1. Each disk 8 has twelve notches, spaced at equal 30 degree intervals, cut in its outer edge. When a disk 8 is mounted, three of these notches mate with the three raised tabs 11 on the upper section, while the remaining nine notches align with the finger notches 7 in the upper section, permitting access to them. FIG. 2 shows the opposite side of the disk 8 which appears in FIG. 1. The disks are reversible and can be printed on both sides. This particular disk 8 is printed with math problems and with radial lines which define twelve problem-containing sections. Disks can also be printed symmetrically with two, three, four, or six sections, or asymmetrically with any number of sections.

Typically, the present invention is used in playing children's games. The method of usage is as follows: Indicia-bearing disks are added to the device simply by placing them on top of the device. Referring to FIG. 1, since there are twelve disk notches that can mate a given tab 11 on the upper section 2, the disks can be placed in any of twelve different orientations. Disks can be put in place easily by children—a slight turn of the wrist is all that is required to obtain mating between a disk 8 and the upper section 2. The spinner's indicia can be changed by either turning a disk over, or by replacing it with another.

In playing games, the rotating pointer is spun with a finger to randomly select items in the indicia. If the pointer selects an item which is not oriented correctly for proper viewing by the user, the upper section can be turned such that the item is right side up. This can be done by means of the finger notches 7, shown in FIG. 1, with a motion similar to that of dialing a telephone. This feature can be particularly useful to children when the indicia consist of printed words or numbers, since they may have some difficulty in reading these even when oriented correctly.

Because the indicia-bearing disks are affixed to the upper section of the device (by mating tabs and notches), and because there is a frictional engagement between the upper section and pointer, the pointer can continue pointing to the same item in the indicia after the upper section has been turned. This prevents users from losing track of which item has been selected when the indicia are reoriented.

Various changes could be made in the preferred embodiment described above. In place of the indicia-bearing disks, indicia-bearing cards of various other shapes could be employed. These shapes could differ in either the number of notches, overall shape, or both. The fundamental requirement is that the cards be symmetrical, to permit their mounting in multiple orientations for easier mounting. For example, cards having an overall hexagonal shape with six notches could be used. These could be mounted in six different orientations. Square cards having four notches could be mounted in four orientations.

More or less than three tabs could be used on the upper section. As long as the device included the raised portion 13 in center of the upper section, shown in FIG. 6, only one tab would be sufficient to keep the indicia-bearing cards in place. If the raised portion 13 were omitted, a minimum of two tabs would be required. The shape of the tabs could also be altered significantly.

As an alternative method of keeping indicia-bearing cards in place on the upper section, linear raised areas along the outside of the upper section could be used in conjunction with straight edged cards. The card edges would fit snugly inside the raised areas. In this case, no card notches would be required for mating purposes.

In addition to these changes, various other modifications could be made with respect to the disclosed embodiment without altering the fundamental nature of the present invention. The invention should not be considered limited by this embodiment, but rather by the spirit and scope of the claims below.

What is claimed is:

1. A spinner comprising a base, an upper section mounted pivotally on the base by means of a central member which protrudes through a hole in the base, a pointer mounted revolvably on the upper section by means of a fastener seated in the central member, and a set of interchangeable indicia-bearing cards having holes in their centers large enough to accomodate the spinner's pointer and having a symmetric shape which is capable of mating with raised areas on the upper section when placed on the upper section in a multiplicity of orientations, thus holding the cards in place with respect to the upper section.

2. A spinner device according to claim 1, wherein a fastening device is attached to the central member, serving to prevent the upper section and base from separating when the device is picked up.

3. A spinner device according to claim 1, wherein the central member includes a resiliently deformable beaded collar which permits the upper section and base to be snapped together and subsequently prevents their separation.

4. A spinner device according to claim 1, where the central member consists of a separate part which is joined to the upper section after the upper section and base have been brought together, having an enlarged end which prevents the base and upper section from separating after it has been joined to the upper section.

5. A spinner according to claim 1, where the base has a raised section, upon which the upper section rests, to reduce the turning friction between the upper section and base.

6. A spinner device according to claim 1, wherein high friction foot pads are attached to the base to help prevent the device from skidding when the upper section is being turned.

7. A spinner device comprising a base, an upper section mounted pivotally on the base having finger notches in its outer edge, a pointer revolvably mounted on the upper section, and a set of interchangeable indicia-bearing cards having holes in their centers large enough to accomodate the spinner's pointer, having notches in their outer edges which coincide with and permit access to the finger notches in the upper section, and having a symmetric shape which is capable of mating with raised areas on the upper section when placed on the upper section in a multiplicity of orientations.

8. A spinner device according to claim 7, where the raised areas on the upper section include tabs which mate with the notches cut in the outer edges of the indicia-bearing cards.

9. A spinner device in accordance with claim 8, where the number of tabs is three.

10. A spinner device in accordance with claim 8, where the number of notches in the indicia-bearing cards is twelve.

11. A spinner device according to claim 7, where said notches in the cards' outer edges serve a dual purpose, mating with raised areas on the upper section and also permitting access to said finger notches in the upper section.

12. A spinner device according to claim 7, where the indicia-bearing cards are reversible and are printed on both sides.

* * * * *